US006669024B2

(12) United States Patent
Ottens

(10) Patent No.: US 6,669,024 B2
(45) Date of Patent: Dec. 30, 2003

(54) SWEEPER MAGNET

(75) Inventor: Corey J. Ottens, Morrison, IL (US)

(73) Assignee: National Manufacturing Co., Sterling, IL (US)

( * ) Notice: Subject to any disclaimer, the term of this patent is extended or adjusted under 35 U.S.C. 154(b) by 0 days.

(21) Appl. No.: 10/140,160

(22) Filed: May 8, 2002

(65) Prior Publication Data

US 2003/0209917 A1 Nov. 13, 2003

(51) Int. Cl.[7] ..... H01F 7/20

(52) U.S. Cl. ..... 209/215; 294/65.5; 294/19.1; 335/285

(58) Field of Search ..... 209/215; 294/65.5, 294/19.1

(56) References Cited

U.S. PATENT DOCUMENTS

| | | | | |
|---|---|---|---|---|
| 2,405,655 A | | 8/1946 | Kehoe | |
| 2,426,795 A | | 9/1947 | Sjostrom | |
| 2,648,434 A | | 8/1953 | Russell | |
| 2,654,480 A | | 10/1953 | Stem | |
| 2,709,002 A | | 5/1955 | Hoff | |
| 2,954,257 A | | 9/1960 | Besuch et al. | |
| 2,970,003 A | | 1/1961 | Heath, Jr. et al. | |
| 3,014,586 A | | 12/1961 | Ross | |
| 3,343,675 A | | 9/1967 | Budd | |
| 3,384,408 A | | 5/1968 | Furzey | |
| 3,646,492 A | | 2/1972 | Westermann | |
| 4,017,386 A | | 4/1977 | Barry | |
| 4,105,239 A | | 8/1978 | Akczinski, Sr. | |
| D256,543 S | | 8/1980 | George | |
| 4,407,038 A | | 10/1983 | Haase | |
| 4,593,766 A | | 6/1986 | Gossard | |
| 4,802,702 A | * | 2/1989 | Bownds | 294/65.5 |
| 5,065,537 A | | 11/1991 | Bailey | |
| 5,285,904 A | | 2/1994 | Haase | |
| 5,395,148 A | | 3/1995 | Jameson et al. | |
| 5,408,818 A | | 4/1995 | Damron | |
| 5,413,225 A | | 5/1995 | Shields | |
| 5,481,983 A | | 1/1996 | Guzman et al. | |
| 5,624,146 A | | 4/1997 | De Los Reyes et al. | |
| 5,868,258 A | | 2/1999 | Hubbard, Jr. | |
| 5,979,957 A | | 11/1999 | Conrad et al. | |
| 5,999,074 A | | 12/1999 | Coleman, Jr. et al. | |
| 6,113,169 A | | 9/2000 | Gohman et al. | |
| 6,124,777 A | * | 9/2000 | Snider | 335/285 |
| 6,142,310 A | | 11/2000 | Haase et al. | |
| 6,158,792 A | | 12/2000 | Snider | |

FOREIGN PATENT DOCUMENTS

| | | |
|---|---|---|
| CA | 2122513 | 10/1994 |
| DE | 1 265 950 | 4/1968 |
| DE | 2 297 266 | 2/1983 |
| GB | 639039 | 6/1950 |
| GB | 1500553 | 2/1978 |
| GB | 2 295 491 A | 6/1996 |
| GB | 2 329 282 A | 3/1999 |

* cited by examiner

*Primary Examiner*—Donald P. Walsh
*Assistant Examiner*—Jonathan R Miller
(74) *Attorney, Agent, or Firm*—Marshall, Gerstein & Borun LLP

(57) ABSTRACT

A sweeper magnet for attracting magnetic debris from a pick-up surface includes a base assembly and a magnet having a first surface supported by the base assembly and a second surface. A cover extends over the magnet second surface and includes a projection having a projection height extending away from the magnet. The projection automatically creates a space distance of at least the projection height between the pick-up surface and at least a portion of the cover to provide clearance for attracting the magnetic debris.

20 Claims, 3 Drawing Sheets

SWEEPER MAGNET

FIELD OF THE INVENTION

The present invention generally relates to pick-up tools and, more particularly, to sweeper magnets.

BACKGROUND OF THE INVENTION

Conventional sweeper magnets typically include a magnet assembly attached to an elongate handle. The magnet assembly includes a base adapted for attachment to the handle and a magnet attached to the base. During use, the magnetic sweeper is positioned in sufficient proximity to a pick-up surface so that the magnet attracts magnetic debris on the surface. The magnetic debris is pulled to the surface of the magnet or a magnet cover plate, and is subsequently removed, often manually.

Such conventional magnetic sweepers are overly difficult and cumbersome to use. Care must be taken to insure that the magnet assembly is spaced a proper distance from the pick-up surface. If the magnet assembly is spaced too far, the magnetic debris will not be attracted to the magnet. On the other hand, if the magnet assembly is spaced too close to the pick-up surface, there will be insufficient clearance to place the magnet assembly over the magnetic debris. Accordingly, in order to achieve the proper spacing, a user must manually support the magnetic sweeper at a proper distance above the pick-up surface.

Some magnetic sweepers are known which include wheels for supporting the magnet above the pick-up surface. These sweepers are typically large, as far as magnet pick-up tools are concerned, and the wheels are usually placed on outside ends of the magnet assembly. Accordingly, such magnetic sweepers are unsuitable for retrieving magnetic debris from pick-up surfaces having minimal clearance.

DETAILED DESCRIPTION

An exemplary sweeper magnet 10 constructed in accordance with the teachings of the present invention is illustrated in FIGS. 1–5. The sweeper magnet 10 may be used to collect magnet debris from a pick-up surface. As used herein, "magnetic debris" refers to any object formed of ferromagnetic material that may be retrieved by a sweeper magnet, such as screws, paperclips, and the like. Furthermore, "pick-up surface" refers to any surface on which magnetic debris may be deposited.

The sweeper magnet includes a base assembly 12 attached to a coupling 16 adapted for removable attachment to an elongate handle (not shown). The coupling 16 may include internal threads (not shown) that mate with external threads provided on the handle. The internal threads may be of a standard size so that the coupling 16 may be removably attached to standard handles of various lengths.

Figure 1:
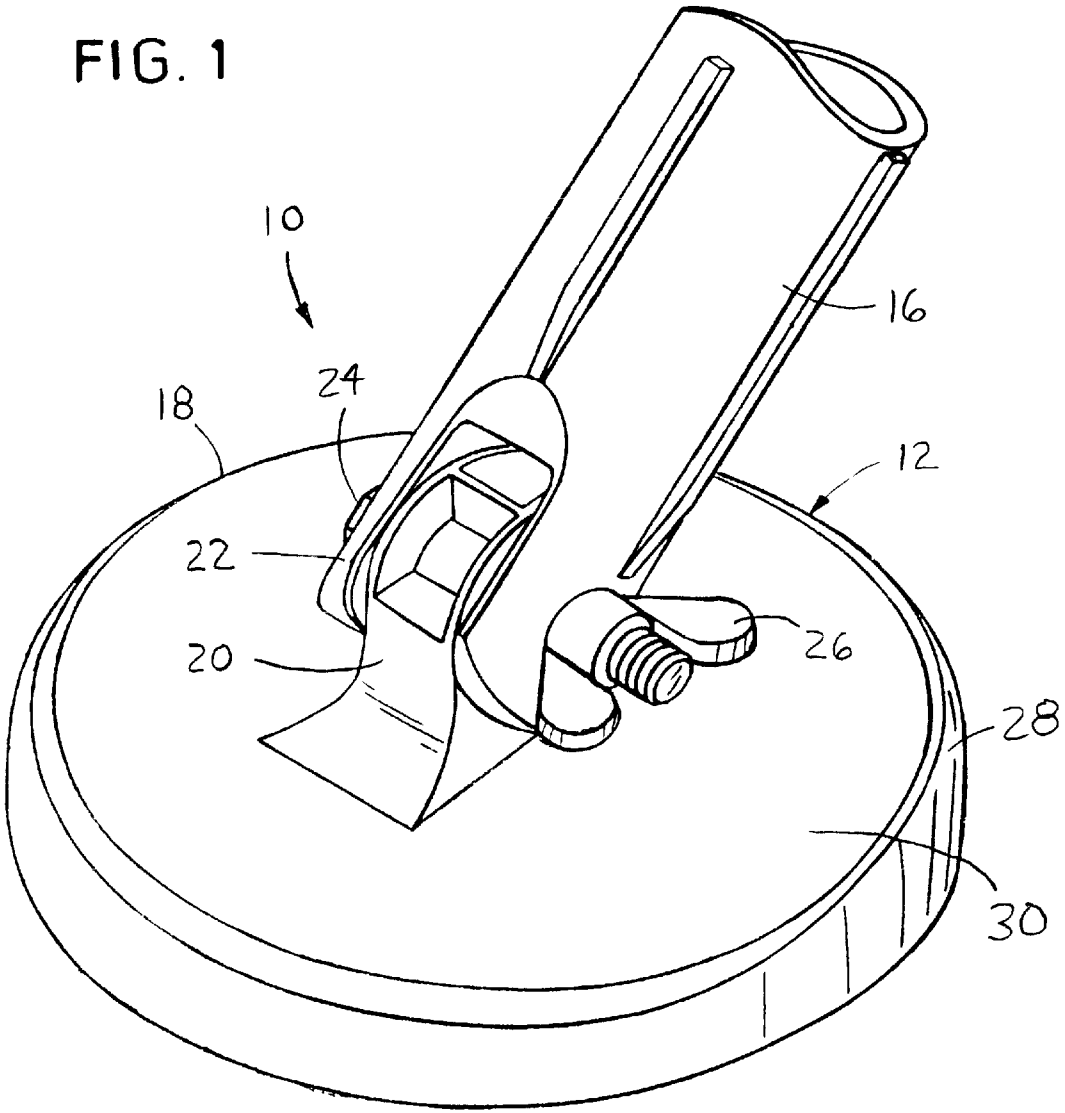
FIG. 1 is a top perspective view of a sweeper magnet constructed in accordance with the teachings of the present invention.
Figure 2:
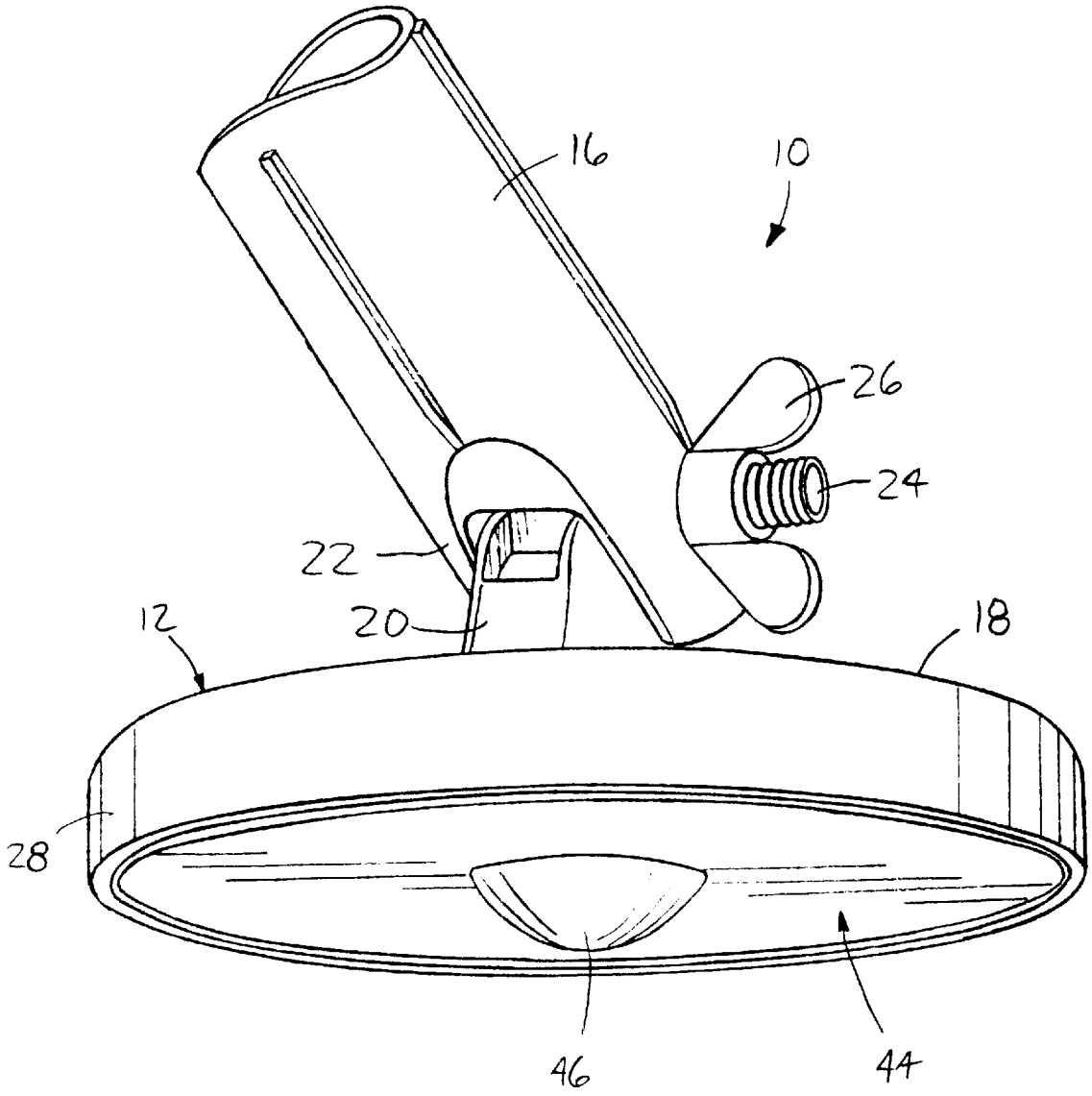
FIG. 2 is a bottom perspective view of the sweeper magnet of FIG. 1.

The base assembly 12 includes a base 18 pivotably attached to the coupling 16 (FIG. 1). For example, the base 18 may include a boss 20 sized for insertion into a yoke 22 formed at an end of the coupling 16. A bolt 24 may then be inserted through holes formed in the boss 20 and yoke 22 and secured by a fastener 26. Accordingly, the coupling 16 may rotate with respect to the base 18 about the bolt 24, and the coupling 16 may be secured in selected angular positions with respect to the base 18 by tightening the fastener 24.

Figure 3:
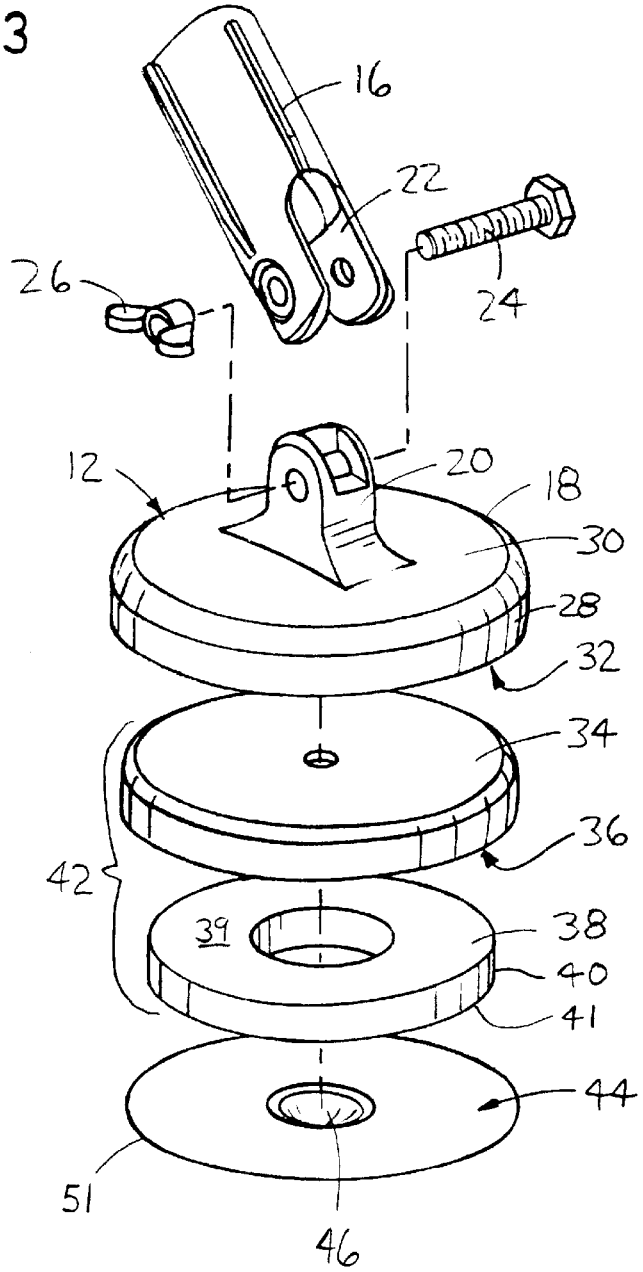
FIG. 3 is an exploded perspective view of the sweeper magnet of FIGS. 1 and 2.

As best shown in FIGS. 1 and 3, the base 18 includes a cylindrical side wall 28 depending from a periphery of a top wall 30 to define a cup recess 32. A mounting cup 34 is sized for insertion into the cup recess 32 and, in turn, defines a magnet recess 36. A magnet, such as annular magnet 38, has an outside diameter 40 sized for insertion into the magnet recess 36. The magnet 38 has a first surface 39 adapted for attachment, such as with an adhesive, to the mounting cup 34, and an exposed second surface 41. The magnet 38 and attached mounting cup 34 form a cup magnet assembly 42 that may be inserted into the cup recess 32 and attached to the base 18, also preferably with an adhesive.

The base 18 and coupling 16 are preferably formed of a plastic (e.g., ABS or nylon) or similar material that is easily molded into an attractive design, while the mounting cup 34 is made of a metal material.

A magnet cover 44 is positioned over a bottom face 46 of the magnet 38. The cover 44 is generally circular and has an outside diameter 46 sized to closely mach an outside diameter of the mounting cup 34. The cover 44 may be secured in any known manner. In the exemplar embodiment, the cover 44 is formed of a ferromagnetic material, so that the magnetic field generated by the magnet 38 holds the cover 44 in place.

Figure 4:
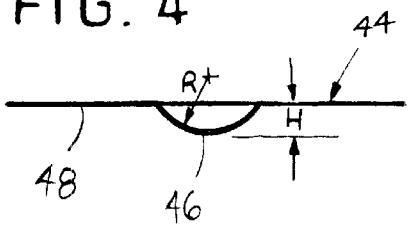
FIG. 4 is a side elevation view of a cover provided with the magnet sweeper of FIGS. 1–3.

The cover 44 includes a projection, such as bubble 46, for automatically spacing the magnet 38 from a pick-up surface. In the illustrated embodiment, the bubble 46 is formed in a central portion of the cover 44, so that the cover 44 has a generally planar annular portion 48 extending about a periphery of the bubble 46. As best shown in FIG. 4, the bubble 46 has a height H so that, when the sweeper magnet 10 is placed on a pick-up surface, at least a portion of the cover 44 is spaced from the pick-up surface by a distance equal to at least the height H. The height H is selected so that it creates sufficient clearance between the planar cover portion 48 and the pick-up surface for common types of magnetic debris. In an exemplary embodiment, the height H is approximately 0.25 inches.

Figure 5:
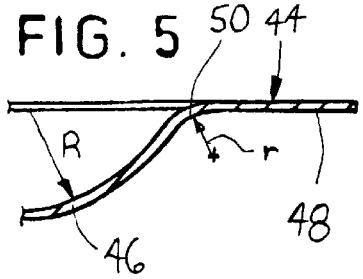
FIG. 5 is an enlarged detail of a portion of the cover of FIG. 4.

A transition area 50 of the cover 44, between the planar portion 44 and the bubble 46, may be formed with a gradual slope so that the bubble 46 does not snag or catch on the pick-up surface. As best shown in FIG. 5, the transition area 50 is formed with a radius r, which may be approximately 0.1 inches. Furthermore, the bubble 46 is formed with a continuous curve to avoid the formation of sharp edges or other profiles that may snag or damage the pick-up surface. As best shown in FIG. 4, the bubble 46 has a dome-like shape with a constant radius R, which may be on the order of approximately 0.5 inches.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A sweeper magnet for attracting magnetic debris from a pick-up surface, the sweeper magnet comprising:

a base assembly;

a magnet having a first surface supported by the base assembly and a second surface; and a unitary cover extending over at least a portion of the magnet second surface, the cover including a projection having a projection height extending away from the magnet;

wherein the projection automatically creates a space distance of at least the projection height between the pick-up surface and at least a portion of the cover to provide clearance for attracting the magnetic debris.

2. The sweeper magnet of claim 1, in which the projection extends from a central portion of the cover and the cover includes a substantially planar portion surrounding the projection.

3. The sweeper magnet of claim 2, in which the cover includes a transition area between the cover planar portion and the cover projection.

4. The sweeper magnet of claim 3, in which the transition area is formed with a radius.

5. The sweeper magnet of claim 4, in which the transition area radius is equal to approximately 0.1 inches.

6. The sweeper magnet of claim 1, in which the cover comprises a ferromagnetic material, and in which the magnet secures the cover in place.

7. The sweeper magnet of claim 1, in which the base assembly includes a base supporting the magnet and a coupling pivotably attached to the base.

8. The sweeper magnet of claim 7, in which the coupling includes a threaded end.

9. The sweeper magnet of claim 1, further comprising a mounting cup having a magnet recess sized to receive the magnet, wherein the magnet is secured to the mounting cup and the mounting cup is secured to the base assembly.

10. The sweeper magnet of claim 1, in which the projection comprises a bubble.

11. The sweeper magnet of claim 1, in which the bubble is formed along a radius of approximately 0.5 inches.

12. The sweeper magnet of claim 1, in which the projection height is equal to approximately 0.25 inches.

13. A sweeper magnet for attracting magnetic debris from a pick-up surface, the sweeper magnet comprising:

a base assembly including a base having a cylindrical side wall depending from a top wall to define a cup recess, and a coupling pivotably attached to the base;

a mounting cup sized for insertion into the base cup recess and attached to the base, the mounting cup defining a magnet recess;

an annular magnet sized for insertion into the mounting cup magnet recess, the magnet including a first surface attached to the mounting cup and a second surface; and a unitary cover sized to extend over at least a portion of the magnet second surface, the cover including a projection having a projection height extending away from the magnet;

wherein the projection automatically creates a space distance of at least the projection height between the pick-up surface and at least a portion of the cover to provide clearance for attracting the magnetic debris.

14. The sweeper magnet of claim 13, in which the projection extends from a central portion of the cover and the cover includes a substantially planar portion surrounding the projection.

15. The sweeper magnet of claim 14, in which the cover includes a transition area between the cover planar portion and the cover projection.

16. The sweeper magnet of claim 15, in which the transition area is formed with a radius.

17. The sweeper magnet of claim 16, in which the transition area radius is equal to approximately 0.1 inches.

18. The sweeper magnet of claim 13, in which the cover comprises a ferromagnetic material, and in which the magnet secures the cover in place.

19. The sweeper magnet of claim 13, in which the projection comprises a bubble.

20. The sweeper magnet of claim 13, in which the projection height is equal to approximately 0.25 inches.

* * * * *